US011480017B2

(12) United States Patent
Huxtable

(10) Patent No.: US 11,480,017 B2
(45) Date of Patent: Oct. 25, 2022

(54) CONNECTOR APPARATUS

(71) Applicant: Weatherford U.K. Limited, Leicestershire (GB)

(72) Inventor: Graeme Robert Huxtable, Norfolk (GB)

(73) Assignee: Weatherford U.K. Limited, Leicestershire (GB)

( * ) Notice: Subject to any disclaimer, the term of this patent is extended or adjusted under 35 U.S.C. 154(b) by 0 days.

(21) Appl. No.: 16/330,175

(22) PCT Filed: Sep. 19, 2017

(86) PCT No.: PCT/GB2017/052781

§ 371 (c)(1),
(2) Date: Mar. 4, 2019

(87) PCT Pub. No.: WO2018/055350

PCT Pub. Date: Mar. 29, 2018

(65) Prior Publication Data

US 2019/0203542 A1 Jul. 4, 2019

(30) Foreign Application Priority Data

Sep. 23, 2016 (GB) ..... 1616216.6

(51) Int. Cl.

| | |
|---|---|
| ***E21B 23/00*** | (2006.01) |
| ***E21B 17/02*** | (2006.01) |
| ***E21B 17/06*** | (2006.01) |
| ***E21B 23/04*** | (2006.01) |
| ***E21B 31/00*** | (2006.01) |

(52) U.S. Cl.
CPC ..... *E21B 17/023* (2013.01); *E21B 17/06* (2013.01); *E21B 23/04* (2013.01); *E21B 31/00* (2013.01)

(58) Field of Classification Search
CPC ..... E21B 23/00; E21B 23/03; E21B 23/04; E21B 17/023; E21B 17/06; E21B 31/00
See application file for complete search history.

(56) References Cited

U.S. PATENT DOCUMENTS 5,158,142 A 10/1992 Schlumberger
5,568,836 A * 10/1996 Reid ..... E21B 17/023 166/237

(Continued)

FOREIGN PATENT DOCUMENTS

CN 202325475 U 7/2012
EP 0686753 A2 12/1995

(Continued)

OTHER PUBLICATIONS

Search Report in counterpart UK Appl. GB1616216.6, dated Feb. 28, 2017, 4-pgs.

(Continued)

*Primary Examiner* — Brad Harcourt
(74) *Attorney, Agent, or Firm* — Blank Rome LLP

(57) ABSTRACT

A releasable connector apparatus has a connector mandrel to be coupled to a conveyance and a housing to be coupled with a downhole tool. A socket is defined within the housing for receiving the mandrel. A latch arrangement operable within the socket has a latch member and is moveable relative to the housing between a connect position (in which the latch is locked relative to the mandrel to prevent removal of the mandrel from the socket), and a disconnect position (in which the latch is unlocked relative to the mandrel to permit removal of the mandrel from the socket). A cavity defined within the housing is sealingly isolated from the socket. An actuator mounted within the cavity is coupled to the latch arrangement to move relative to the housing between a first position (in which the arrangement is in its connect position), and a second position (in which the arrangement is in its disconnect position).

22 Claims, 3 Drawing Sheets

(56) References Cited

U.S. PATENT DOCUMENTS

| | | | | |
|---|---|---|---|---|
| 5,810,088 | A | 9/1998 | Lamirand et al. | |
| 9,605,493 | B2 | 3/2017 | Lauder | |
| 2006/0278388 | A1* | 12/2006 | Zanca | E21B 17/023 166/242.6 |
| 2010/0078173 | A1 | 4/2010 | Buytaert et al. | |
| 2011/0259601 | A1 | 10/2011 | Withers | |
| 2016/0281451 | A1 | 9/2016 | Breaux et al. | |
| 2017/0009533 | A1 | 1/2017 | Moyes | |

FOREIGN PATENT DOCUMENTS

| | | | |
|---|---|---|---|
| EP | 1197631 | A2 | 4/2002 |
| EP | 2381063 | A2 | 10/2011 |
| EP | 2458133 | A2 | 5/2012 |
| EP | 2458133 | A3 | 2/2013 |
| WO | 2010146305 | A1 | 12/2010 |
| WO | 2011/110813 | A2 | 9/2011 |
| WO | 2014/055061 | A1 | 4/2014 |
| WO | 2019112980 | A1 | 6/2019 |

OTHER PUBLICATIONS

Int'l Search Report and Written Opinion in counterpart PCT Appl. PCT/GB2017/052781, dated Nov. 24, 2017, 17-pgs.
Examination report in counterpart EP Appl. 17771568.7, dated Feb. 4, 2022, 6-pgs.

* cited by examiner

CONNECTOR APPARATUS

FIELD

Disclosed examples relate to a releasable connector apparatus for use in providing a releasable connection with a downhole tool.

BACKGROUND

In the oil and gas exploration and production industry tools are deployed and operated in a well bore using various conveyance media, such as wireline, coiled tubing, jointed pipe and the like. One consideration in wireline operations is the strength of the wire or cable, and in the event of a tool becoming stuck downhole, wire breakage is a common problem. Even if the wire does not break, for example during attempts by an operator to free the tool by applying tension in the wire, it is often necessary to drop a cutter bar and cut the wire.

In some circumstances significant lengths of wire may be left in the well, possibly "bird nested". Remedial operations typically require finders to be run to locate the top of the wire and ball this up, followed by grabs to retrieve the wire. It is often the case that the wire needs to be retrieved in manageable amounts leading to multiple fishing runs and a large amount of rig time to just reach the top of the rope socket on the stuck tool.

To minimize the risk or requirement for wire-breaks/cutting, a time delayed releasable connector has been proposed which provides a releasable connection between the wire and tool. Such a connector is configured to maintain a connection while the wire is under tension by the effect of the weight of the tool. However, in the event of the tool hanging-up or becoming stuck, the loss in tension within the wire will initiate a time-delayed release of the connector. An example of a time delayed releasable connector is disclosed in U.S. Pat. No. 5,568,836, which is incorporated herein by reference.

SUMMARY

An aspect of the present disclosure relates to a releasable connector apparatus for use in providing a releasable connection between a conveyance member, such as wireline, and a downhole tool. The apparatus may function to permit disconnection between the conveyance member and the downhole tool in a controlled manner. Disconnection may be achieved in response to an initiation event. The initiation event may be provided in response to the weight of the tool being at least partially removed from the conveyance member, such as might occur when the tool is hung-up in a well.

The connector apparatus may facilitate a time delayed disconnection following an initiation event.

The connector apparatus may comprise an actuator for use in reconfiguring the apparatus from a connected configuration to a disconnected configuration. The actuator may be operated in response to the initiation event. The actuator may comprise a spring biased actuator. The actuator may comprise or be associated with a time delay arrangement, such as a hydraulic metering arrangement.

The actuator may be isolated, for example sealed, within a cavity formed in the connector apparatus. Such isolation may assist to eliminate or minimize exposure of the actuator to well fluids and/or pressures. For example, the actuator may be protected from interference from well debris. Further, the apparatus may be isolated from pressure applied forces which may otherwise provide an adverse or undesired biasing force on the actuator.

An aspect of the present disclosure relates to a releasable connector apparatus for use in providing a releasable connection between a conveyance member and a downhole tool, the apparatus comprising: a connector mandrel to be coupled to a conveyance member; a connector housing to be coupled with a downhole tool; a socket defined within the connector housing for receiving the connector mandrel; a latch arrangement operable within the socket and comprising a latch member, wherein the latch arrangement is moveable relative to the connector housing between a connect position in which the latch member is locked relative to the connector mandrel to prevent removal of the connector mandrel from the socket, and a disconnect position in which the latch member is unlocked relative to the connector mandrel to permit removal of the connector mandrel from the socket; a cavity defined within the connector housing, wherein the cavity is sealingly isolated from the socket; and an actuator mounted within the cavity and coupled to the latch arrangement, wherein the actuator is moveable relative to the housing between a first position in which the latch arrangement is in its connect position, and a second position in which the latch arrangement is in its disconnect position.

By virtue of the socket being configured to receive the connector mandrel, at least in some configurations during use the socket may be exposed to downhole conditions, such as well fluids and pressures. By sealingly isolating the cavity from the socket, fluid and/or pressure communication between the socket and the cavity may be prevented or minimized. Such an arrangement may assist to isolate the actuator from exposure to well fluids when the releasable connector apparatus is deployed/operated in a well, thus minimizing ingress of well debris, abrasive material, adverse chemicals and the like, which may otherwise interfere with the operation of the actuator. Further, such an arrangement may maintain the cavity in a preferred, for example clean, environment, such that any remedial attention, such as cleaning, of the connector apparatus may be minimized before reuse.

In some known examples efforts may be made to eliminate debris by use of filter arrangements. However, such filter arrangements are sensitive to plugging, which might adversely affect operations. Sealing the socket from the cavity may assist in avoiding or minimizing the requirement to use any filter arrangements.

The cavity may be sealingly isolated from the socket such that fluid pressure within the socket is prevented from applying a biasing force on the actuator. Such an arrangement may avoid the requirement for the actuator to overcome the effect of well pressure, and/or to minimize the risk of premature or inadvertent operation of the actuator by the effect of well pressure, and/or the like.

The latch arrangement may be axially moveable relative to the connector housing between its connect and disconnect positions. In some examples the latch arrangement may be rotationally moveable relative to the connector housing between its connect and disconnect positions.

The connector mandrel may comprise a latch recess, wherein the latch member is moveable to selectively engage and disengage the latch recess. In one example the latch member may be radially moveable to selectively engage and disengage the latch recess.

The latch recess may comprise a circumferential recess. The latch recess may be circumferentially continuous. Alternatively, the latch recess may be circumferentially discontinuous.

When the latch arrangement is in its connect position the latch member may be supported, for example radially supported, to prevent the latch member from moving to disengage the latch recess. When the latch arrangement is in its disconnect position the latch member may be desupported, for example radially desupported, to permit the latch member to move to disengage the latch recess.

In one example, when the latch arrangement is in its connect position the latch member may be supported in a radially inward position and in engagement with the connector mandrel. When the latch arrangement is in its disconnect position the radial support to the latch member may be removed.

The releasable connector apparatus may comprise a support region and a desupport region, wherein when the latch arrangement is in its connect position the latch member is aligned with the support region, and when the latch arrangement is in its disconnect position the latch member is aligned with the desupport region. The support region and desupport region may be defined by the connector housing. The support region and desupport region may be provided on a unitary component of the connector housing. Alternatively, the support region and desupport region may be provided on separate components of the connector housing.

The desupport region may define a region of relief relative to the support region. The desupport region may define a larger diameter than the support region.

The latch arrangement may comprise a latch sleeve which is operable within the socket. The latch sleeve may be moveable, by the actuator, relative to the connector housing between the connect and disconnect positions. The latch sleeve may be axially moveable relative to the housing between the connect and disconnect positions.

The latch member may be mounted on the latch sleeve. In some examples the latch sleeve may define a latch member housing. The latch member may be radially moveable relative to the latch sleeve. In one example the latch member may be mounted within a latch pocket defined in a wall of the latch sleeve. The latch pocket may extend radially through the wall of the latch sleeve.

The latch member may be integrally formed with the latch sleeve. Alternatively, the latch member may be separately formed from the latch sleeve.

The latch member may comprise a dog. The latch member may comprise a key member. The latch member may comprise a collet member.

In one example a single latch member may be provided. Alternatively, multiple latch members may be provided, for example a number of circumferentially arranged latch members.

At least a portion of the connector mandrel may be received within the latch sleeve.

The latch arrangement may be supported, for example axially supported, by the housing when the latch arrangement is in one of its connect and disconnect positions. Such an arrangement may permit pressure induced forces applied on the latch arrangement to be directed into the housing. This may assist to prevent such forces from being applied to the actuator.

The latch arrangement may be supported, for example axially supported, by the housing at least when the latch arrangement is in its disconnect position. Such an arrangement may permit pressure induced forces applied on the latch assembly to be reacted into the housing at least when the connector mandrel is permitted to be removed from the socket. This may be advantageous in some circumstances, for example where a sealing effect initially provided by the connector mandrel when received within the socket is removed.

The apparatus may comprise a sealing arrangement for sealing the cavity from the socket. The sealing arrangement may comprise a unitary sealing component. Alternatively, the sealing arrangement may comprise multiple components or features which collectively operate to provide sealing between the cavity and socket. In some examples the sealing arrangement may be divided across different features of the apparatus. For example, at least one of the connector mandrel, latch arrangement, and connector housing may define a portion of the sealing arrangement.

The sealing arrangement may be configured to fluidly isolate the cavity from the socket. The sealing arrangement may be configured to isolate the actuator from exposure to pressure generated forces applied by fluid within the socket. Thus, the actuator may be permitted to operate without or with minimal influence from surrounding fluid pressure.

The sealing arrangement may comprise a sealing plug. The sealing plug may sealingly engage the housing. The sealing plug may sealingly engage the latch arrangement. For example, the sealing plug may be at least partially located within the latch arrangement, for example within a latch sleeve of the latch arrangement. In such an arrangement the sealing plug may sealingly engage an inner surface of the latch arrangement, such as an inner surface of the latch sleeve.

The sealing plug may comprise at least one seal member, such as at least one O-ring or the like.

The sealing plug may comprise or define a dynamic seal. The sealing plug may be configured to provide sealing engagement with the latch arrangement during relative movement, for example relative axial movement, between the sealing plug and the latch arrangement. Such relative movement may be provided or present during movement of the latch arrangement between its connect and disconnect positions. This arrangement may facilitate reconfiguration of the latch arrangement under the operation or control of the actuator assembly, while assisting to maintain the cavity sealingly isolated from the socket.

The sealing plug may be engaged with the connector housing. The sealing plug may be supported by the connector housing. Such an arrangement may direct fluid pressure forces applied on the sealing plug into the connector housing. This may assist to prevent such forces from being applied to the actuator. In one example the sealing plug may be axially supported by the connector housing. The sealing plug may be engaged with an axial shoulder provided on or associated with the connector housing. The axial shoulder may be defined by an annular lip, for example.

The sealing plug may directly engage the connector housing. Alternatively, the sealing plug may indirectly engage the connector housing, for example via an intermediate component or structure.

The sealing plug may be supported on a plug support sleeve, wherein the plug support sleeve is engaged with or supported by the connector housing. At least a portion of the plug support sleeve may be integrally formed with the sealing plug. At least a portion of the plug support sleeve may be separately formed and secured to the sealing plug, for example via a threaded connection or the like.

At least a portion of the plug support sleeve may be integrally formed with the connector housing. At least a portion of the plug support sleeve may be separately formed and secured to the connector housing, for example via a threaded connection or the like.

As will be described in more detail below, the plug support sleeve may accommodate a transmission connection between the actuator and the latch arrangement. For example, the plug support sleeve may define one or more slots, for example axially extending slots, to accommodate connection keys extending between the actuator and the latch arrangement.

The sealing arrangement may comprise a latch seal interposed between the latch arrangement and the connector housing. In one example the latch seal may be interposed between a latch sleeve of the latch arrangement and the connector housing.

The latch seal may function in combination with the sealing plug to sealingly isolate the socket form the cavity.

The latch seal may comprise at least one seal member, such as at least one O-ring or the like.

The latch seal may comprise or define a dynamic seal. The latch seal may be configured to provide a seal between the latch arrangement and the connector housing during relative movement therebetween.

The latch seal may provide a seal between the latch arrangement and the connector housing when the latch arrangement is in one or both of its connect and disconnect positions. The latch seal may provide a seal between the latch arrangement and the connector housing at least when the latch arrangement is in its disconnect position. Such an arrangement may assist to ensure the cavity remains sealingly isolated from the socket when the connector mandrel is permitted to be or is removed from the socket.

The latch seal may be mounted on the latch assembly, for example on a latch sleeve of the latch assembly. The latch seal may be configured to provide a seal with an inner surface of the connector housing.

The sealing arrangement may comprise a connector mandrel seal. The connector mandrel seal may be interposed between the connector mandrel and at least one of the connector housing and the latch arrangement when the connector mandrel is received within the socket of the connector housing.

The connector mandrel seal may function in combination with the sealing plug and optionally the latch seal to sealingly isolate the socket form the cavity, at least when the connector mandrel is received within the socket of the connector housing.

The connector mandrel seal may be interposed between the connector mandrel and both the connector housing and the latch arrangement. In one example the connector mandrel seal may axially straddle an interface between the connector housing and the latch arrangement.

The connector mandrel seal may axially straddle the latch member of the latch arrangement.

In some examples when the connector mandrel is received within the socket the connector mandrel seal may isolate the latch seal from exposure to fluids/pressure within the socket.

In one example the sealing plug and the connector mandrel seal may establish a seal within the latch assembly at axially spaced regions on the latch assembly. In one example the axially spaced regions may define a substantially common diameter. The provision of the axially spaced seals within the latch assembly may assist to minimize any net pressure force applied on the latch assembly by fluid pressure within the socket, thus minimizing the effect of any pressure force being applied on the actuator via the latch assembly.

The connector mandrel seal may comprise at least one seal member, such as at least one O-ring or the like. At least one seal member may be interposed between the connector mandrel and the latch arrangement, and at least one seal member may be interposed between the connector mandrel and the connector housing.

The connector mandrel seal may be mounted on the connector mandrel.

The connector mandrel may comprise an internal cavity which is in communication with the socket of the connector housing when the connector mandrel is received therein. In one example the cavity may define an opening, for example at one end of the connector mandrel, wherein the opening provides communication between the cavity and the socket when the connector mandrel is received therein. The cavity may be provided in the form of a bore, such as a blind bore extending into the connector mandrel, for example one end of the connector mandrel. The cavity may be coaxially arranged with the connector mandrel.

The internal cavity of the connector mandrel may be configured to be arranged in communication with the environment surrounding the connector apparatus. In use, the surrounding environment may include a well environment. The cavity may therefore facilitate communication between the socket and the surrounding environment. This arrangement may assist to prevent or minimize the risk of the connector mandrel being hydraulically locked within the socket, which may otherwise prevent removal of the connector mandrel when disconnection is required.

The connector mandrel may define one or more external ports for facilitating communication between the cavity and the surrounding environment. At least one external port may extend generally laterally of the connector mandrel.

The internal cavity of the connector mandrel may be filled with a medium. Both the socket of the connector housing and the internal cavity of the connector mandrel may be filled with a medium. The medium may comprise a solid or semi-solid medium. The medium may comprise a high viscosity medium. The medium may provide resistance to wash out. The medium may comprise a gel. The medium may comprise a grease, for example.

The pressure of the medium, when in place within the internal cavity of the connector mandrel and optionally the socket of the connector housing, may be substantially equalized with the pressure of the environment surrounding the releasable connector apparatus. Such equalization may be achieved by virtue of the cavity being in communication with the surrounding environment, for example via one or more external ports. The medium may therefore facilitate pressure equalization, while minimizing exposure of the socket and cavity from fluids within the surrounding environment, such as well fluids.

The connector mandrel may comprise an injector arrangement, for permitting a medium to be injected into the connector mandrel, for example into the cavity of the connector mandrel. The injector arrangement may permit a medium to be injected into the socket when the connector mandrel is located therein. During initial set-up of the connector apparatus, the medium may be injected until the medium is visibly identified exiting one or more external ports. The injector arrangement may facilitate injection of a medium prior to deploying the connector apparatus downhole.

The injector arrangement may comprise a connector, such as a connection nipple, which may facilitate attachment of an injection device, such as a grease injection gun. The injector arrangement may comprise a conduit extending within the cavity to permit injection of the medium via the conduit. The conduit may open into a preferred region of the cavity and/or socket. The conduit may assist to provide a complete fill of the cavity and socket, for example by minimizing the risk of the medium short circuiting from a point of injection to one or more external ports.

The connector mandrel may comprise a connection arrangement for facilitating connection with a conveyance member. For example, the connection arrangement may comprise a wedge connector, spool connector or the like.

The apparatus may comprise a transmission connection providing a connection between the actuator and the latch assembly. Such a transmission connection may permit the actuator to cause relative movement between the latch assembly and the connector housing.

The transmission connection may provide a connection between the actuator and a latch sleeve of the latch assembly.

The transmission connection may provide an axial connection between the actuator and the latch assembly.

The transmission connection may comprise a transmission member extending between the actuator and the latch assembly. The transmission member may extend radially between the actuator and the latch assembly. The transmission member may be provided separately from both the actuator and the latch assembly. Alternatively, the transmission member may be integrally formed with at least one of the actuator and the latch assembly.

The transmission member may comprise a key, for example.

A single transmission member may be provided. Alternatively, a plurality of transmission members may be provided.

The transmission connection may extend through a portion of the sealing arrangement to engage the latch assembly. In one example the transmission connection may extend through a plug support sleeve. For example, the plug support sleeve may comprise or define a slot, such as an axially extending slot, for accommodating the transmission connection.

The actuator may comprise an actuator rod. The actuator rod may be generally elongate. The actuator rod may extend axially within the cavity of the connector housing. The actuator rod may comprise a unitary component. The actuator rod may comprise multiple components secured together. The actuator rod may be moveable relative to the connector housing between its first and second positions, respectively corresponding to the connect and disconnect positions of the latch arrangement.

The actuator may comprise a force arrangement for applying a motive force between the actuator and the connector housing, for example between the actuator rod and the connector housing. The force arrangement may be configured to apply a motive force between the actuator and the connector housing in at least one direction. For example, in one example the force arrangement may be configured to apply a motive force between the actuator and the connector housing to move the actuator towards its second position, corresponding to the disconnect position of the latch arrangement.

The force arrangement may be configured to apply a bias force between the connector housing and the actuator in one direction. For example, the force arrangement may be configured to apply a bias force between the connector housing and the actuator in a direction to move and/or hold the actuator in its second position, corresponding to the disconnect position of the latch arrangement. In this arrangement the actuator may be moved and/or held relative to the connector housing against the bias force to configure or maintain the latch arrangement in its connect position.

In one example the actuator may be moved and/or held relative to the connector housing against the bias force by action of gravity on the connector housing and any associated tool. That is, the weight of the connector housing and any associated downhole tool, when suspended from a conveyance member via the connector mandrel (for example deployed within a wellbore), may be used to move/hold the actuator in its first position, corresponding to the connect position of the latch arrangement. In such an arrangement, with weight applied and tension generated within the conveyance member the latch arrangement will be held within its connect position to maintain a connection with the connector mandrel.

The weight of the connector housing and associated tool may be effectively used by virtue of the connector mandrel being connected to the latch assembly, and the latch assembly being moveable relative to the connector housing.

The force arrangement may be selected or configured such that the weight of the connector mandrel and associated downhole tool may be sufficient to overcome or exceed an output force of the force arrangement.

The force arrangement may be configured to move the actuator towards its second position, corresponding to the disconnect position of the latch arrangement, in response to an initiation event.

The initiation event may comprise at least partial removal of the weight of the connector housing and associated downhole tool from the connector mandrel. Such an initiation event may result in a reduction in tension applied in a conveyance member associated with the connector mandrel.

In some uses the weight of the connector housing and any associated tool may be at least partially removed in the event of snagging or hanging-up of the downhole tool. Such an arrangement may permit disconnection of the conveyance member from the downhole tool, simplifying the subsequent fishing procedure.

The initiation event may comprise a signal transmitted to the releasable connector apparatus. The signal may comprise a mechanical signal, for example transmitted via manipulation of the conveyance member. The signal may comprise an electrical signal, optical signal, pressure signal and/or the like.

The force arrangement may comprise an energy storage device.

The force arrangement may comprise an elastic arrangement. The force arrangement may comprise a spring arranged to act, for example axially act, between the actuator and the housing. The force arrangement may comprise a mechanical spring, gas spring or the like.

The actuator may comprise an axial shock absorbing arrangement. The axial shock absorbing arrangement may be configured to absorb axial shock loading. Such shock absorption may assist to avoid or minimize such axial shock loading from causing any premature movement of the latch arrangement to its disconnect position. The axial shock absorbing arrangement may comprise a Belleville spring arrangement.

The releasable connector apparatus may comprise a damping mechanism associated with the actuator to delay or restrict the rate of relative movement between the actuator and the connector mandrel in at least one direction. The damping mechanism may form part of the actuator.

The damping mechanism may delay or restrict the rate of relative movement of the actuator towards its second position, corresponding to the disconnect position of the latch arrangement. This may provide a time delay prior to the latch arrangement being fully positioned in its disconnect position to permit release of the connector mandrel. The time delay may permit operations to be performed for a time period without necessarily causing a disconnect. For example, a temporary removal or reduction in weight applied on a conveyance member via the connector mandrel may be permitted without causing disconnection from the connector housing.

The damping mechanism may provide greater damping to relative movement between the actuator and the connector housing in one direction than in an opposite direction. For example, the damping mechanism may provide increased resistance to movement of the actuator in a direction towards its second position than in a direction towards is first position. Such an arrangement may facilitate more rapid movement of the latch arrangement to its connect position.

The damping mechanism may comprise a hydraulic metering arrangement.

The damping mechanism may comprise a piston arrangement moveable within a fluid chamber. The fluid chamber may be provided or defined within the connector housing. Accordingly, the piston arrangement and the housing may be moveable relative to each other to cause movement of the piston arrangement within the fluid chamber. The fluid chamber may comprise a fluid, such as oil.

The piston arrangement may be mounted on a piston rod. The piston rod may be coupled with or form part of the actuator, such that movement of the actuator may cause corresponding movement of the piston arrangement.

The piston arrangement may divide the fluid chamber into first and second chamber regions. Movement of the piston arrangement may vary the respective volumes of the first and second chamber regions. In one example movement of the piston arrangement which is associated with movement of the actuator towards its first position may involve an increase in the volume of the second chamber region and a corresponding decrease in the volume of the first chamber region. Conversely, movement of the piston arrangement which is associated with movement of the actuator towards its second position may involve an increase in the volume of the first chamber region and a corresponding decrease in the volume of the second chamber region.

The piston arrangement may permit fluid to pass between the first and second fluid chambers during movement of the piston arrangement. The piston arrangement may provide resistance to such fluid flow in at least one direction, to provide damping of movement of the actuator.

The piston arrangement may comprise a single flow path facilitating fluid flow between the first and second fluid chambers. The piston arrangement may comprise a variable resistance arrangement which provides an increase in resistance to flow in one direction along the flow path.

The piston arrangement may comprise a first flow path configured to permit fluid flow from the first chamber region to the second chamber region during movement of the piston arrangement which is associated with movement of the actuator towards its first position. The first flow path may comprise a one way valve arrangement which permits flow form the first chamber region to the second chamber region, while preventing reverse flow. The one way valve arrangement may comprise a check ball valve, for example.

The piston arrangement may comprise a second flow path configured to permit fluid flow from the second chamber region to the first chamber region during movement of the piston arrangement which is associated with movement of the actuator towards its second position. The second flow path may define a smaller flow area, for example significantly smaller flow area, than the first flow path. This may permit the second flow path to provide a larger flow resistance than the first flow path.

The second flow path may be defined by an annular flow path. The second flow path may comprise an orifice.

The damping mechanism may comprise a pressurizing arrangement configured to apply a pressure to the fluid within the fluid chamber. The pressurizing arrangement may comprise a spring biased piston which defines a boundary of the fluid chamber. The pressurizing arrangement may apply a pressure within the fluid chamber which is associated with the spring force of the spring biased piston.

The pressurizing arrangement may be in pressure communication with the cavity. Such an arrangement may provide a degree of pressure balancing between the cavity and the fluid chamber.

The pressurizing arrangement may function to accommodate thermal expansion of fluid within the fluid chamber.

The cavity may be air filled, for example at atmospheric pressure. Such an arrangement may permit the cavity, and thus actuator, to be provided in a relatively clean environment. Further, such an arrangement may avoid exposure of the actuator to excessive pressure forces.

The connector housing may be provided as a unitary component. Alternatively, the connector housing may be provided as multiple components coupled together, for example via threaded connections. One or more connections between individual housing components may be sealed, for example via O-ring seals or the like. Such an arrangement may seal the cavity from the surrounding environment.

The housing may define at least one access aperture to enable access to the actuator. Such access may permit an operator to move the actuator towards its first position to permit a connection to be made with the connector mandrel when said mandrel is received within the socket of the connector housing. The at least one access aperture may permit insertion of a tool, such as a lever tool, to move the actuator.

The releasable connector apparatus may comprise a cover member arranged to selectively close the at least one access aperture. The cover member may comprise a cover sleeve which is mounted on the connector housing to selectively cover the at least one access aperture. The cover member may be threadedly secured to the housing. The cover member may be sealingly engaged with the housing to seal the cavity.

The connector housing may be arranged to be secured to a downhole tool via a threaded connection, for example. The connector housing may be arranged to be secured to a tool string.

The connector mandrel may be configured to be coupled to any suitable conveyance member, such as wireline, tubing or the like.

An aspect of the present disclosure relates to a releasable connector apparatus for use in providing a releasable connection between a conveyance member and a downhole tool, the apparatus comprising: a connector housing to be coupled with a downhole tool; a socket defined within the connector housing for receiving a connector mandrel associated with a conveyance member; a latch arrangement operable within the socket and moveable relative to the connector housing between a connect position to prevent removal of the connector mandrel from the socket, and a disconnect position to permit removal of the connector mandrel from the socket; a cavity defined within the connector housing, wherein the cavity is sealingly isolated from the socket; and an actuator mounted within the cavity and coupled to the latch arrangement, wherein the actuator is moveable relative to the housing between a first position in which the latch arrangement is in its connect position, and a second position in which the latch arrangement is in its disconnect position.

An aspect of the present disclosure relates to a connector housing, for example for use in any other aspect.

An aspect of the present disclosure relates to a connector mandrel, for example for use in any other aspect.

An aspect of the present disclosure relates to a method for providing a releasable connection between a downhole tool and a conveyance member. The method may comprise using a releasable connection apparatus according to any other aspect.

Features of one aspect may form part of any other aspect described herein and are not repeated for brevity.

BRIEF DESCRIPTION OF THE DRAWINGS

These and other aspects will now be described, by way of example only, with reference to the accompanying drawings, in which.

DETAILED DESCRIPTION OF THE DRAWINGS

Figures 1A, 1B, 1C:
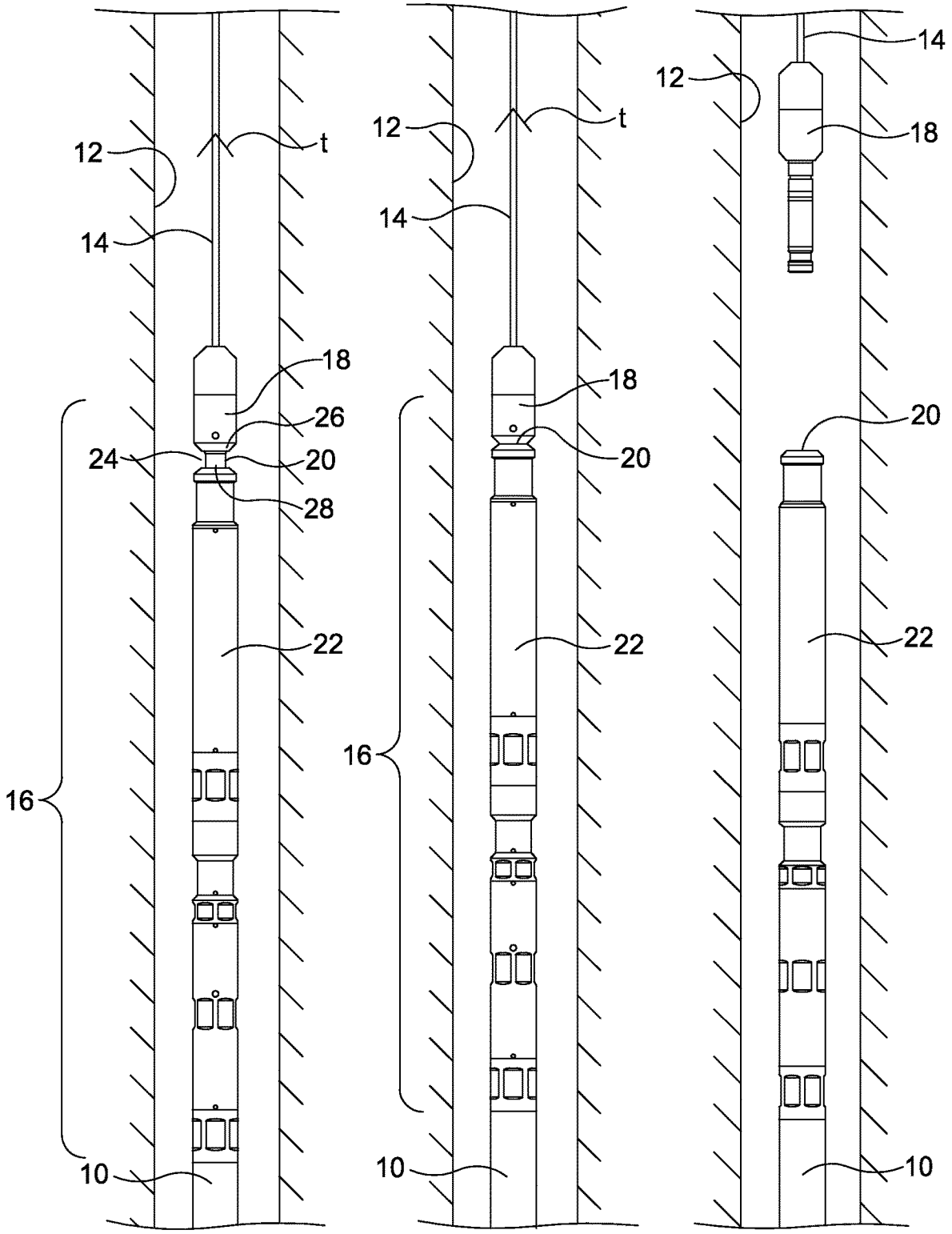
FIGS. 1A to 1C diagrammatically illustrate sequential stages in the release of an example releasable connector apparatus.

FIG. 1A diagrammatically illustrates a downhole tool or tool string 10 being deployed in a wellbore 12 on a wireline conveyance member 14. The downhole tool 10, which may comprise any suitable tool, is connected to the wireline 14 via a releasable connector apparatus 16, which includes a connector mandrel 18 coupled to the wireline 14 and received and connected within a socket 20 of a connector housing 22, with the connector housing 22 coupled to the tool 10.

During normal operations the weight of the connector housing 22 and tool 10 apply tension T in the wireline 14, with the housing 22 and tool 10 suspended from the connector mandrel 18 such that a relief separation 24 is present between a shoulder 26 of the mandrel 18 and an upper end 28 of the housing 22.

In the event of the tool 10 becoming stuck in the bore, illustrated in FIG. 1B, at least some of the weight will be removed from the wireline 14, resulting in a lower applied tension t. In response to the reduction in applied weight an actuator (not shown) within the connector housing 22 will effectively draw the connector mandrel 18 further into the socket 20, under control of a slow action damping mechanism (not shown), closing the relief separation 24 (FIG. 1A). Such action will cause a latch arrangement (not shown) within the socket 20 of the housing 22 to release the connector mandrel 18, allowing the connector mandrel 18 and wireline 14 to be retrieved, as illustrated in FIG. 1C.

As will be described in further detail below, the releasable connector apparatus 16 is configured such that the actuator within the connector housing 22 is isolated from the socket 20 of the housing 22, to avoid exposure of the actuator to well fluids, materials and pressures, which may otherwise compromise the effective operation of the actuator.

The releasable connector 16 may be used in a contingency situation, for example in the event of the tool 10 becoming stuck. In such a case a subsequent fishing operation may be performed to retrieve the tool 10, without having to handle or manage any length of remaining wireline. However, in other applications the releasable connector 16 may be used as a reliable apparatus to intentionally leave the downhole tool 10 deployed within the wellbore 12 without having to maintain the connection with the wireline 14.

Figure 2:
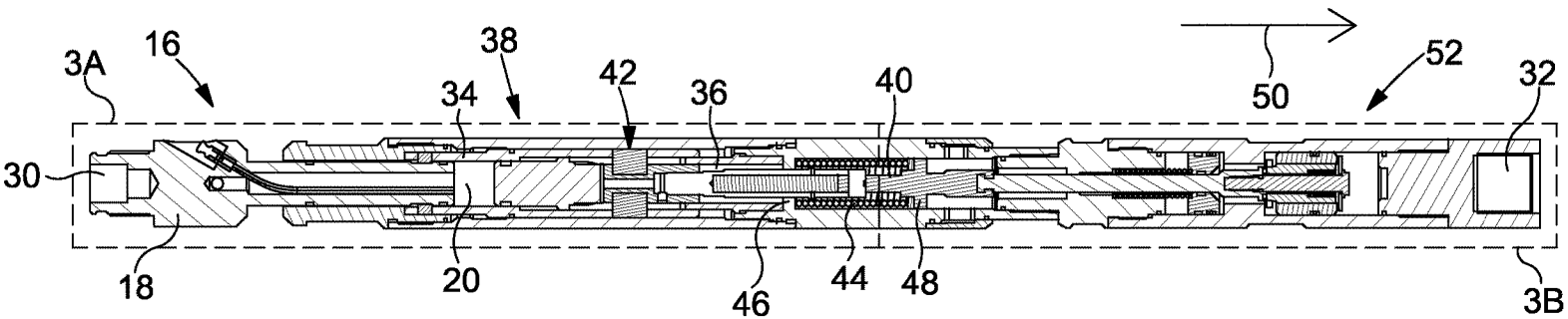
FIG. 2 provides a cross-sectional illustration of an example releasable connector apparatus, shown in a connect configuration.

FIG. 2 provides a longitudinal cross-sectional view of the releasable connector apparatus 16, illustrated in the connected configuration of FIG. 1A. The apparatus 16 includes the connector mandrel 18 which facilitates connection with wireline (not shown) via upper connector 30, and the connector housing 22 which facilitates connection with the downhole tool (not shown) via lower connector 32. In the example illustrated the housing 22 is formed of multiple components secured and sealed together.

The housing 22 defines the socket 20 which receives the mandrel 18. A latch arrangement 34 is operable within the socket 30 to facilitate connection and disconnection from the mandrel 18. As will be described in more detail below, the latch arrangement 34 is axially moveable within the housing 22 between a connect position (shown in FIG. 2) in which a connection with the connector mandrel is achieved, and a disconnect position (shown in FIG. 4 and described later) in which the connector mandrel 18 can be released.

The housing defines a cavity 36 which is sealingly isolated from the socket via a sealing arrangement 38, which will be described in detail below. In the present example the cavity 36 may be filled with air at atmospheric pressure. However, in other examples the cavity may be filled with an alternative composition, at a desired pressure.

An actuator 40 is located within the cavity 36 and is coupled to the latch arrangement 34 via a transmission connection 42. The actuator 40 is moveable within the cavity 36 between a first position (shown in FIG. 2) in which the latch arrangement 34 is in its connect position, and a second position (shown in FIG. 4 and described later) in which the latch arrangement 34 is in its disconnect position. As the cavity 36 is isolated from the socket 20, the actuator 40 will be protected from exposure to fluids and pressure within the socket 20. This may allow the actuator 40 to avoid compromise and/or damage by well debris, for example. Further, this may permit the actuator 40 to operate to cause the connector mandrel 18 to be released without any bias effect caused by the surrounding fluid pressure.

The actuator 40 includes a force arrangement in the form of a spring 44 which acts axially between an annular lip 46 on the housing 22 and an annular lip 48 on the actuator 40. The spring 44 acts to bias the actuator 40 in the direction of arrow 50 relative to the housing 22, to seek to move the actuator 40 from its first position (FIG. 2), to its second position (FIG. 4) and permit the mandrel 18 to be released. When the apparatus 16 is in use, the weight of the housing 22 and any connected tool will compress the spring 44, retaining the actuator 40 in its first position, thus maintaining the connection with the connector mandrel 18. When sufficient weight has been removed, for example by the connected tool hanging-up in a well, the spring 44 will cause the actuator 40 to move relative to the housing 22 to ultimately move the latch arrangement 34 to its disconnect position. In this respect, the spring 44 will typically be selected in accordance with the weight of the connector housing 22 and downhole tool.

The apparatus 16 includes a hydraulic damping mechanism or arrangement 52 which is coupled to or forms part of the actuator 40. The damping mechanism 52 functions to restrict the permitted rate of movement of the actuator 40 towards its second position. Accordingly, the damping mechanism 52 may function as a time-delay mechanism to delay release from the connector mandrel 18. Such a time delay may allow the apparatus 16 to accommodate temporary reductions in applied weight, such as during temporary tool hang-up events, during intended tool manipulations and the like. The damping mechanism 52 may permit a more rapid movement of the actuator 40 to its first position.

Figure 3A:
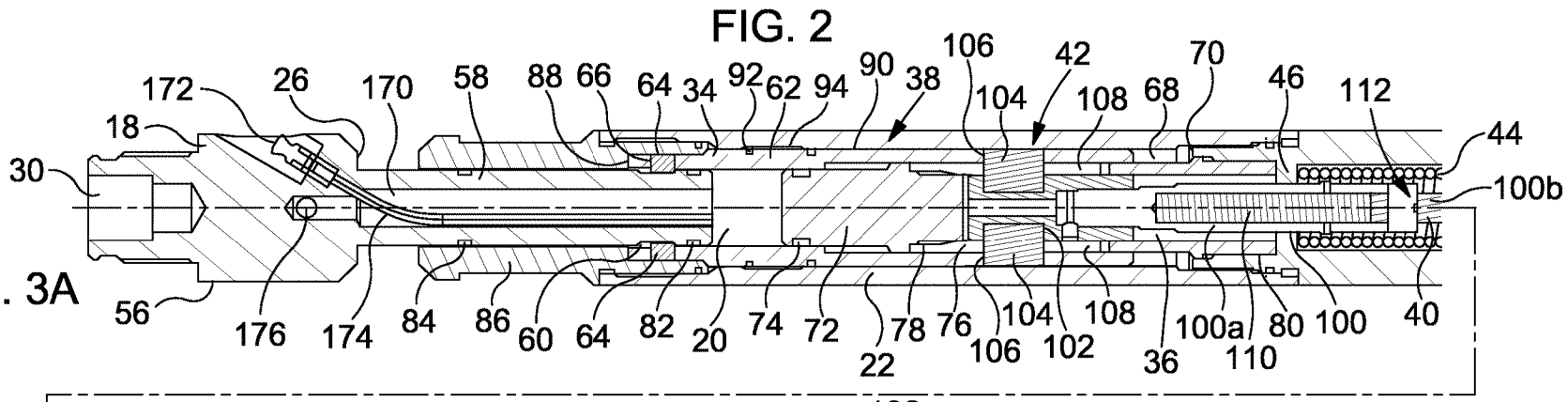
FIGS. 3A and 3B provide enlarged views of portions of the releasable connector apparatus of FIG. 2, in regions 3A and 3B respectively.
Figure 3B:
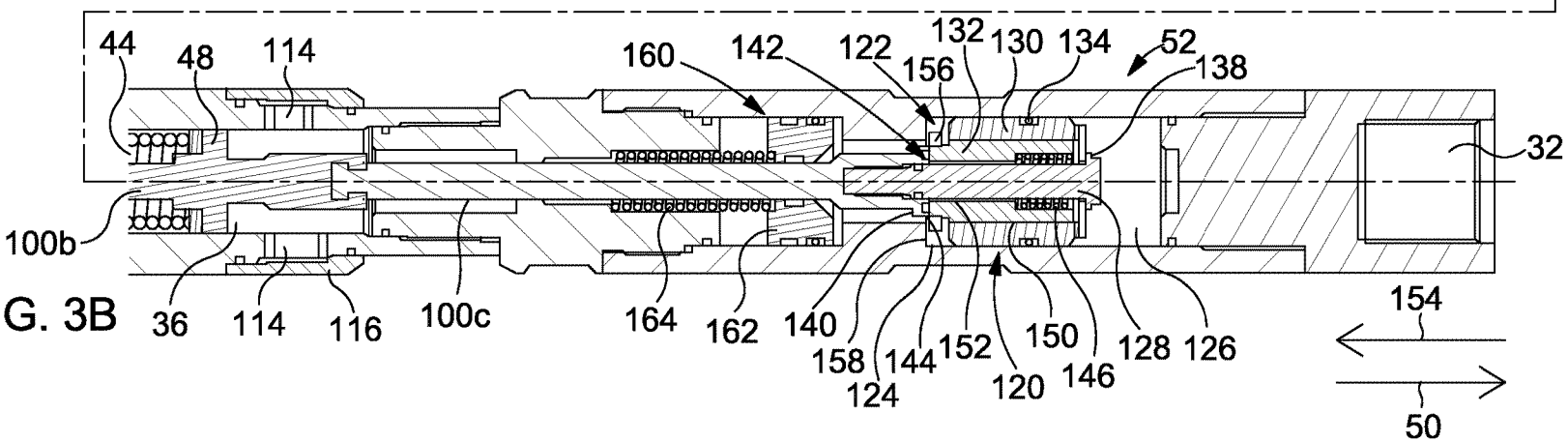

A more detailed description of the features of the releasable connector apparatus 16 will now be provided with reference to FIGS. 3A and 3B, wherein FIG. 3A provides an enlarged view of the apparatus 10 in region 3A of FIG. 2, and FIG. 3B provides an enlarged view of the apparatus 10 in region 3B of FIG. 2.

The connector mandrel 18 comprises a head portion 56 in which is formed the upper connector 30, and a stab-in portion 58 which is received within the socket 20 of the connector housing 22, with the shoulder 26 defining a transition between the head and stab-in portions 56, 58. The stab-in portion 58 comprises a circumferential recess 60 at a distal end thereof, which, as will be described in detail below, facilitates connection with the latch arrangement 34.

The latch arrangement 34 includes a latch sleeve 62 which carries a number of circumferentially arranged latch members or keys 64 mounted in respective radial slots 66. When the latch sleeve 62 is positioned in the illustrated connect position the latch keys 64 are received within the recess 60 of the connector mandrel 18, and radially constrained by the housing 22 to thus be locked within the recess 60. In this configuration the connector mandrel 18 is prevented from withdrawing from the socket 20, with the load applied by the weight of the connector housing 22 and any associated tool transferred into the connector mandrel 18 through the engagement of the latch keys 64 and recess 60.

When the latch sleeve 62 is in the illustrated connect position a lower end 68 thereof is axially separated from a shoulder 70 defined by the housing 22. This axial separation permits the latch sleeve 62 to be moved axially within the housing 22 towards its disconnect position, as will be described in more detail below.

As noted above, the cavity 36 is isolated from the socket 20 by a sealing arrangement 38. In the present example the sealing arrangement 38 is defined by multiple components, including a sealing plug 72 which is mounted within the latch sleeve 62 and provides a seal with an inner surface of the latch sleeve 62 via an O-ring 74. The sealing plug 72 is mounted on a plug support sleeve 76, via threaded connection 78, and the plug support sleeve 76 is secured to the housing 22 via threaded connection 80, with the lower end 82 of the plug support sleeve 76 abutted against the annular lip 46 of the housing 22. As such, the sealing plug 72 is effectively supported by the housing 22, with any forces acting on the plug 72 by virtue of fluid pressure within the socket 20 being transmitted into the housing 22, and thus having limited or no effect on the actuator 40.

The connector mandrel 18, when received within the socket 20, functions as part of the sealing arrangement, assisting to isolate the cavity 36 from the socket 20. The stab-in portion 58 of the connector mandrel 18 includes first and second O-rings 82, 84, wherein the first O-ring 82 provides a seal against the inner surface of the latch sleeve 62, and the second O-ring provides a seal against the inner surface of the housing 22, more specifically against an inner surface of a fishing neck sub 86 of the housing 22, with each O-ring 82, 84 sealed against a common inner diameter. The first and second O-rings 82, 84 thus axially straddle the latch members 64 and also an interface 88 between the latch sleeve 62 and fishing neck sub 86 of the housing 22. Accordingly, when the connector mandrel 18 is received within the socket 20, fluid from the surrounding environment is prevented from flowing or entering region 90 between the latch sleeve 62 and housing 22. Thus, in the illustrated connect configuration, the cavity 36 is isolated from the socket 20 by virtue of a sealing arrangement composed of at least the sealing plug 72 and the first and second O-rings 82, 84 provided on the mandrel 18.

An O-ring 92 is mounted on an outer surface of the latch sleeve 62, and functions to provide a seal with the inner surface of the housing 22. In the present example, when the latch sleeve 62 is located in its illustrated connect position the O-ring 92 is aligned with a recess 94 formed in the housing 22, such that no seal is provided. This may assist to prevent hydraulic locking of the latch sleeve 62 during movement relative to the housing 22 to its disconnect position. It should be noted that while the O-ring 92 does not establish a seal when the latch sleeve 62 is in its connect position, the first and second O-rings 82, 84 provided on the mandrel 18 effectively prevent any fluid from entering the region 90 between the latch sleeve and the housing 22. However, and as will be described in more detail below, when the latch sleeve 62 is moved to its disconnect position, the O-ring 92 is moved into sealing engagement with the housing 22, such that when the mandrel 18 is removed from the socket 20, the cavity 36 remains isolated from the socket 20.

The connector mandrel 18 defines an internal cavity in the form of a blind bore 170 which extends into the end of the stab-in portion 58, such that the internal cavity 170 is in communication with the socket 20. The internal cavity 170 and the socket 20 are filled with a grease, injected via a grease nipple 172 and conduit 174. The connector mandrel 18 also includes one or more laterally extending ports 176 which facilitate communication between the cavity 170 and the surrounding environment. In such an arrangement the pressure of the grease will be equalized with the pressure of the surrounding environment. In this respect the grease allows the socket 20 and cavity 170 to be equalized with the surrounding pressure, while preventing exposure of the socket 20 and cavity 170 to well fluids. The pressure equalization is provided to prevent the connector mandrel 18 becoming hydraulically locked within the socket 20.

When in use within a wellbore, the pressure of the grease within the socket 20 will act against the first O-ring 82. However, as the same pressure will be applied externally against the second O-ring 84 which seals against a common diameter, the pressure force applied across the mandrel 18 will be substantially equalized.

Further, the pressure of the grease will act against the sealing plug 72. However, the resulting force applied will be reacted into the housing 22, via the plug support sleeve 76, avoiding exposure of the actuator 40 to pressure forces.

Also, while a portion of the latch sleeve 62 will be exposed to the pressure of the grease, the arrangement of the O-ring 74 of the sealing plug 72 and the first O-ring 82 of the connector mandrel 18 is such that the pressure will not apply any net force on the latch sleeve 62, again effectively avoiding any influence of pressure on the actuator 40.

The actuator 40 comprises an elongate actuator rod 100 which extends longitudinally within the cavity 36, wherein the actuator rod 100 is composed of multiple components secured or arranged together. The transmission connection 42 is provided at an upper end 102 of the actuator rod 100, and in the present example includes two diametrically opposed keys 104 which extend radially between the actuator rod 100 and the latch sleeve 62, being received within respective pockets 106 in the latch sleeve 62. The plug support sleeve 76 comprises a pair of axially extending slots 108 which accommodate the keys 104.

The actuator rod 100 includes a shock absorber arrangement in the form of a spring stack 110 (which may be composed by a disk spring) which is axially interposed between an upper rod portion 100*a* and an intermediate rod portion 100*b*. The intermediate rod portion 100*b* may be defined as a spring rod, and carries the annular lip 48 which is engaged by the spring 44. Axial separation of the upper and intermediate rod portions 100*a*, 100*b* is prevented by a retainer arrangement 112.

The spring stack 110 may function to absorb any shock or impulse loads applied through the actuator. Further, the spring stack 110 may permit a degree of relative movement between the upper and lower rod portions 100*a*, 100*b* which may be used during charging and/or bleeding the damping mechanism 52.

The housing 22 includes access apertures 114 which permit an operator to insert a tool, such as a lever tool, into the cavity 36 to engage the actuator 40, specifically the annular lip 48 on the intermediate rod portion 100*b* to move the actuator 40 towards its illustrated first position, thus arranging the connector apparatus 16 in its connected configuration. The housing 22 includes a threaded cover sleeve 116 which is used to cover and seal the access apertures, thus maintaining the cavity 36 sealed from the surrounding environment.

The damping mechanism 52 is provided in a lower end region of the housing 22, and includes a piston arrangement 120 which is moveable within an oil filled chamber 122 defined within the housing 22, with the piston arrangement 120 dividing the fluid chamber 122 into a first chamber region 124 and a second chamber region 126. The piston arrangement 120 includes a piston shaft 128 which is threadedly secured to a lower actuator rod portion 100*c*, such that the piston arrangement 120 is moved with the actuator 40.

The piston arrangement 120 includes a piston sleeve assembly mounted on the piston shaft 128 and includes an outer piston sleeve 130 mounted on an inner piston sleeve 132, wherein the outer piston sleeve 130 is sealed with the housing 22 via a piston O-ring 134. The piston shaft 128 includes an axial stop shoulder 138 which axially limits or retains the outer piston sleeve 130. A lower end of the lower actuator rod portion 100*c* defines a stop shoulder 140 which axially limits or retains the inner piston sleeve 132. The stop shoulder 140 includes an axially facing O-ring 142 which sealingly engages an upper axial end face 144 of the inner sleeve 132. A spring 146 acts axially between the outer and inner piston sleeves 130, 132, to bias the outer piston sleeve 130 against axial stop shoulder 138, and the inner piston sleeve 132 sealingly against stop shoulder 140.

In use, the piston arrangement 120 permits oil to pass between the first and second chamber regions 124, 126 during movement of the piston arrangement. In the present example the piston arrangement 120 provides a large restriction to the flow of oil when the actuator 40 is moved from its illustrated first position (corresponding to the connect position of the latch arrangement 34) to its second position (corresponding to the disconnect position). In contrast, the piston arrangement 120 provides a low restriction to the flow of oil when the actuator 40 is moved from its second position to its first position.

A first annular flow path 150 is defined between the outer and inner piston sleeves 130, 132, and a second annular flow path 152 is defined between the inner piston sleeve 130 and the piston shaft 128. The first annular flow path 150 defines a smaller, for example significantly smaller, flow area than the second annular flow path 152, thus providing a greater resistance to flow. Although the first and second flow paths are defined as annular, such a geometry may not be strictly necessary. For example, one or both flow paths may be eccentric, or may be defined by one or more individual flow conduits or channels, or the like.

The piston arrangement 120 is configured such that during normal use the first annular flow path 150 permits flow in reverse directions between the first and second chamber regions 124, 126, while the second annular flow path 152 only permits flow from the first chamber region 124 to the second chamber region 126. In such an arrangement during movement of the actuator 40 from its illustrated first (latch connect) position towards its second (latch disconnect) position, flow will only be permitted through the restricted first annular flow path 150, thus providing a large fluid damping effect and restricting the rate of movement. This may provide the desired time-delay before disconnect is achieved. During reverse movement of the actuator 40, flow will also be permitted through the larger second annular flow path 152, allowing more rapid movement or "re-setting" of the actuator 40.

More specifically, during movement of the piston arrangement 120 in the direction of arrow 50 (which corresponds to movement of the actuator 40 towards its second position and the latch arrangement 34 towards is disconnect position), fluid pressure will increase in the second chamber region 126 establishing a pressure differential between the first and second chambers 124, 126, which will lift the outer piston sleeve 130 from the axial shoulder 138 to axially press/hold the inner sleeve 132 (in combination with the bias of the spring 146) into sealing engagement with shoulder 140, effectively sealing the second annular flow path 152. In such a configuration flow will be established from the second chamber 126 to the first chamber only through the restricted first annular flow path 150, damping the movement.

During movement of the piston arrangement 120 in the reverse direction (direction of arrow 154 which corresponds to movement of the actuator 40 towards its first position and the latch arrangement 34 towards is connect position), fluid pressure will increase in the first chamber region 124 establishing a pressure differential between the first and second chambers 124, 126, with flow permitted through the first annular flow path 150 from the first chamber 124 to the second chamber 126. A combination of fluid drag in the first annular flow path 150 and increasing pressure in the first chamber 124 will cause the inner sleeve 132 to lift from its sealing engagement with the axial stop shoulder 140, against the bias of the spring 146, thus permitting flow also through the second annular flow path 152, significantly reducing any damping effect provided by the piston arrangement 120.

The inner sleeve also includes a lift-off shoulder 156 which, upon over-displacement of the actuator 40 in the direction of arrow 154, will engage a corresponding shoulder 158 on the housing 22 and allow the inner sleeve 132 to lift from sealing engagement with stop shoulder 140. Such an arrangement may assist in the filling of oil within the first and second chamber regions 124, 126. For example, oil may be delivered into the second chamber region 126 from a suitable source, and flow relatively unrestricted through the open second annular flow channel into the first chamber region 124. Otherwise, relying only on the first flow path 150 may require a significant time period to complete the fill of the chamber 122. Although not illustrated in FIG. 3B, a bleed port may extend through the housing 22 and in communication with the first chamber region 124 to allow air to bleed during filling.

In one example the over-displacement of the actuator 40 during filling/charging of the damping mechanism 52 may be performed by engagement of the actuator with an operator tool inserted via the access ports 114. Alternatively, the over displacement may be achieved by applying pressure within the second chamber region 126 which, when the lift-off shoulder 156 of the inner sleeve 132 is engaged with the corresponding shoulder 158 of the housing 22, will act on the actuator to cause the over displacement and open the second annular flow path 152. In either example above, the spring stack 110 may permit the over-displacement of the actuator 40 to be achieved.

The over-displacement procedure described above may also be used in circumstances where the chamber 122 is already filled, but it is desired to substantially equalize pressure in the first and second fluid chamber regions 124, 126.

The damping mechanism 52 further comprises a pressurizing arrangement 160 configured to apply a pressure to the oil within the fluid chamber 122. The pressurizing arrangement 160 comprises an annular piston 162 which is sealed against both the housing 22 and the lower actuator rod portion 100*c*, wherein the annular piston 162 defines a boundary of the fluid chamber 122 and of the cavity 36. The annular piston 162 is biased by a spring 164, such that the pressure of the oil within the fluid chamber 122 may be a function of the force applied by the spring and the pressure within the cavity 36. The pressurizing arrangement 160 may also function to accommodate thermal expansion of oil within the fluid chamber 122.

Figure 4:
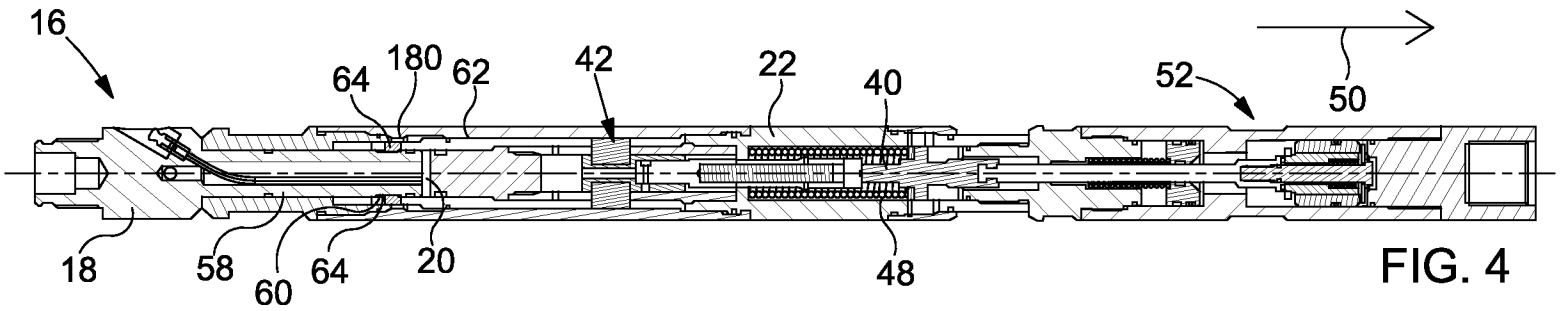
FIG. 4 illustrates the releasable connector apparatus of FIG. 2 in a disconnect configuration.

Reference is now made to FIG. 4 which illustrates the releasable connector apparatus 16 in the configuration of FIG. 1B, in which the connector mandrel 18 is permitted to be removed from the socket 20 of the connector housing 22. Upon removal or reduction of the weight of the connector housing 22 and associated tool from the connector mandrel 18, the spring 48 will cause movement of the actuator 40 towards its second position in the direction of arrow 50, with the transmission connection 42 causing corresponding movement of the latch sleeve 62 towards its disconnect position. Such movement will be damped by the damping mechanism 52 as described above. Engagement of the latch keys 64 with the recess 60 of the connector mandrel 18 will cause the stab-in portion 58 to be drawn further into the socket 20.

Figure 5:
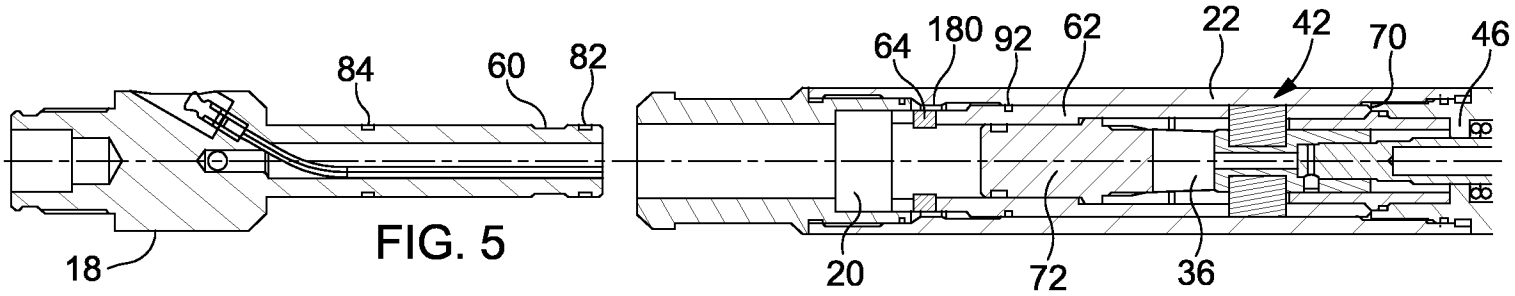
FIG. 5 illustrates a region of the releasable connector apparatus of FIG. 2 with a connector mandrel removed from a connector housing.

When the latch sleeve 62 reaches its disconnect position the latch keys 64 will become aligned with an increased diameter region 180 within the housing 22, removing the radial support to the latch keys 64, such that retrieval of the mandrel 18 from the socket 20 is permitted, as illustrated in FIG. 5.

When the mandrel 18 is removed, the O-ring seals 82, 84 will no longer contribute to any sealing isolation between the socket 20 and the cavity 36. However, when the latch sleeve 62 is located in its disconnect position, the O-ring 90 mounted on the latch sleeve 62 is presented in sealing engagement with the inner surface of the housing 22, thus operating in combination with the sealing plug 72 to maintain the cavity 36 sealed from the socket 20 and surrounding environment. In this configuration external fluid pressure will now apply a force on the latch sleeve 62. However, when the latch sleeve 62 is in the illustrated disconnect configuration the lower end thereof bottoms-out on the shoulder 70 of the housing 22, preventing the actuator 40 from being influenced by the surrounding pressure.

Figure 6:
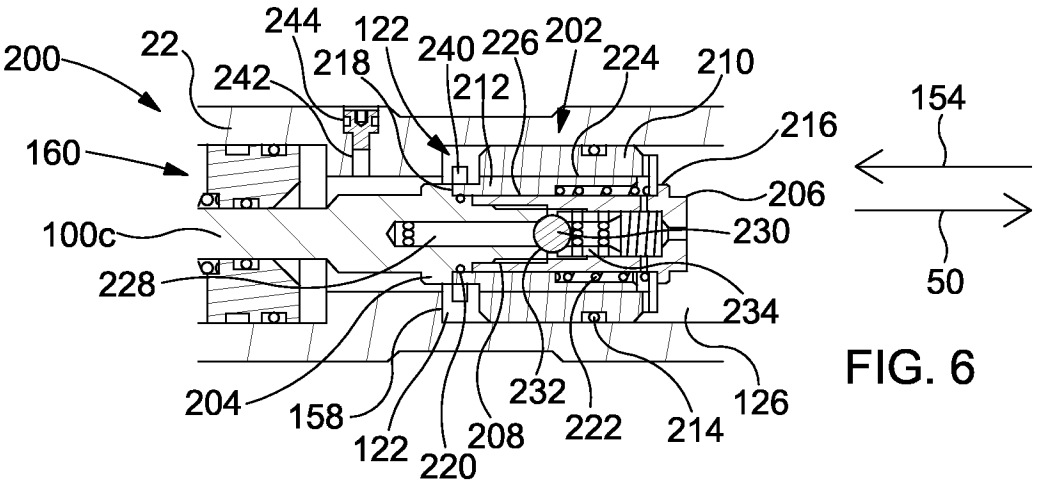
FIG. 6 illustrates an example hydraulic metering arrangement for use in a releasable connector apparatus.

Reference is now made to FIG. 6 which is a cross-sectional view of an alternative example of a damping mechanism 200 which may be used within the connector housing 22.

The damping mechanism 200 is similar in many respects to the damping mechanism 52 described above and includes a piston arrangement 202 which is moveable within the oil filled chamber 122 defined within the housing 22, with the piston arrangement 202 also dividing the fluid chamber 122 into the first chamber region 124 and the second chamber region 126. The piston arrangement 120 includes a piston shaft 204 which in this example is integrally formed with the lower actuator rod portion 100*c* such that the piston arrangement 202 is moved with the actuator 40.

The piston arrangement 202 includes a piston sleeve assembly mounted on the piston shaft 204 and retained by a sleeve retainer 206 which is secured to the piston shaft 204 via a threaded connection 208. The piston sleeve assembly includes an outer piston sleeve 210 mounted on an inner piston sleeve 212, wherein the outer piston sleeve 210 is sealed with the housing 22 via a piston O-ring 214. The sleeve retainer 206 includes an axial stop shoulder 216 which axially limits or retains the outer piston sleeve 210. A lower end of the actuator rod portion 100*c* defines a stop shoulder 218 which axially limits or retains the inner piston sleeve 212. An O-ring 220 is provided on a circumferential surface of the actuator rod portion 100*c*, adjacent the shoulder 218, and functions to provide a seal against an inner surface of the inner piston sleeve 212. The provision of the O-ring seal 220 on a circumferential surface may provide improved stability to the O-Ring, and reduce the likelihood of the O-ring 220 becoming displaced or washed-out when the inner sleeve 212 is moved to expose the O-ring 220. Such displacement may be more likely in axial face seals, such as with O-ring 142 (FIG. 3B) of the piston arrangement 120 described above. As such, the reliability of retaining the metering or damping effect may be improved.

A spring 222 acts axially between the outer and inner piston sleeves 210, 212, to bias the outer piston sleeve 210 against axial stop shoulder 216, and the inner piston sleeve 212 against stop shoulder 218 and in sealing engagement with O-ring 220.

In use, the piston arrangement 202 permits oil to pass between the first and second chamber regions 124, 126 during movement of the piston arrangement, and in a similar manner to the arrangement described above provides an increased resistance to movement of the actuator in a direction to permit disconnection of the connector mandrel 18 from the connector housing 22.

A first flow path 224 is defined between the outer and inner piston sleeves 210, 212, and a second flow path 226 is defined between the inner piston sleeve 212 and the sleeve retainer 206. In the present example the first flow path 224 may define a smaller flow area than the second flow path 226.

A third flow path 228 is provided through the piston arrangement 202, which defines a larger, for example significantly larger, flow area than at least the first flow path 224. A check ball 230 is provided within the third flow path 228 and is engaged with a fixed ball seat 232 and a spring mounted ball seat 234 which acts to bias the check ball 230 against the fixed ball seat 232. Thus, the check ball 230 permits flow in only a single direction, specifically from the first chamber 124 to the second chamber 126. While a check ball is illustrated in the present example, other types of one-way valve arrangement may be utilized.

During normal use, movement of the piston arrangement 202 in the direction of arrow 50 (which corresponds to movement of the actuator 40 towards its second position and the latch arrangement 34 towards is disconnect position), fluid pressure will increase in the second chamber region 126, which will lift the outer piston sleeve 210 from the axial shoulder 216 to axially press/hold the inner sleeve 212 (in combination with the bias of the spring 222) into engagement with shoulder 218 and sealed with the O-ring 220, effectively sealing the second flow path 226. Fluid pressure in the second chamber 126, in combination with the spring mounted ball seat 234 will maintain the check ball 230 against the fixed seat 232, thus sealing the third flow path 228. In such a configuration flow will be established from the second chamber 126 to the first chamber 124 only through the restricted first flow path 224, damping the movement.

During movement of the piston arrangement 202 in the reverse direction (direction of arrow 154 which corresponds to movement of the actuator 40 towards its first position and the latch arrangement 34 towards is connect position), fluid pressure will increase in the first chamber region 124, with flow permitted through the first flow path 224 from the first chamber region 124 to the second chamber region 126. A combination of fluid drag in the first flow path 224 and increasing pressure in the first chamber 124 may cause the inner sleeve 212 to lift from the axial stop shoulder 218 and O-ring 220, against the bias of the spring 222, thus permitting flow also through the second flow path 226, reducing any damping effect provided by the piston arrangement 202.

Further, during movement of the piston arrangement 202 in the direction of arrow 154 the check ball 230 will be lifted from the fixed ball seat 232 against the bias of the spring mounted ball seat 234, thus opening the third flow path 228 and significantly reducing the damping effect of the piston arrangement 202.

The inner sleeve 212 also includes a lift-off shoulder 240 which, upon over-displacement of the actuator 40 in the direction of arrow 154, will engage the shoulder 158 on the housing 22 and allow the inner sleeve 212 to lift from stop shoulder 218 and separated from the O-ring 220, opening the second flow path 226. In a similar manner described above, such an arrangement may assist in the filling of oil within the first and second chamber regions 124, 126, equalizing pressure between the first and second chamber regions 124, 126 and/or the like. A bleed port 242 extends through the housing 22 and in communication with the first chamber region 124 to allow air to bleed during filling or the like. In the example illustrated a bleed screw 244 is located within the bleed port 242.

In one example the over-displacement of the actuator 40 during filling/charging of the damping mechanism 200 may be performed by engagement of the actuator with an operator tool. Alternatively, the over displacement may be achieved by applying pressure within the second chamber region 126 which, when the lift-off shoulder 240 of the inner sleeve 212 is engaged with the corresponding shoulder 158 of the housing 22, will act on the actuator via the check ball 230 pressed against the fixed seat 232, to cause the over displacement and open the second flow path 226.

The damping mechanism 200 further comprises the pressurizing arrangement 160 described above.

It should be understood that the examples described herein are exemplary and that various modifications are possible. For example, the damping mechanism is not exclusively for use with the connector apparatus, and may be used in combination with any other tool or system.

The invention claimed is:

1. A releasable connector apparatus for use in providing a releasable connection between a conveyance member and a downhole tool, the apparatus comprising:

a connector mandrel to be coupled to a conveyance member;

a connector housing to be coupled with a downhole tool;

a socket defined within the connector housing for receiving the connector mandrel;

a latch arrangement operable within the socket and comprising a latch member, wherein the latch arrangement is moveable relative to the connector housing between a connect position in which the latch member is locked relative to the connector mandrel to prevent removal of the connector mandrel from the socket, and a disconnect position in which the latch member is unlocked relative to the connector mandrel to permit removal of the connector mandrel from the socket; and a cavity defined within the connector housing, wherein the cavity is sealingly isolated from the socket such that fluid pressure within the socket is prevented from applying a biasing force on an actuator, the actuator mounted within the cavity and coupled to the latch arrangement, wherein the actuator is moveable relative to the housing between a first position in which the latch arrangement is in its connect position, and a second position in which the latch arrangement is in its disconnect position.

2. The releasable connector apparatus according to claim 1, wherein the cavity is sealingly isolated from the socket such that fluid pressure within the socket is prevented from applying a biasing force on the actuator.

3. The releasable connector apparatus according to claim 1, wherein the latch arrangement comprises a latch sleeve which carries the latch member, the latch sleeve being operable within the socket and moveable by the actuator relative to the connector housing between the connect and disconnect positions, at least a portion of the connector mandrel being receivable within the latch sleeve.

4. The releasable connector apparatus according to claim 1, wherein the latch arrangement is axially supported by the housing when the latch arrangement is in one of its connect and disconnect positions to direct pressure induced forces applied on the latch arrangement into the housing.

5. The releasable connector apparatus according to any preceding claim, comprising a sealing arrangement for sealing the cavity from the socket.

6. The releasable connector apparatus according to claim 5, wherein the sealing arrangement comprises a sealing plug which defines a dynamic seal to provide sealing engagement with the latch arrangement during relative movement between the sealing plug and the latch arrangement effected by reconfiguration of the latch arrangement under the operation of the actuator assembly.

7. The releasable connector apparatus according to claim 6, wherein the sealing plug is axially supported by the connector housing to direct pressure forces applied on the sealing plug into the connector housing.

8. The releasable connector apparatus according to any one of claim 6, wherein the sealing plug is supported on a plug support sleeve and the plug support sleeve is engaged with or supported by the connector housing, wherein the plug support sleeve accommodates a transmission connection between the actuator and the latch arrangement.

9. The releasable connector apparatus according to claim 5, wherein the sealing arrangement comprises a latch seal interposed between the latch arrangement and the connector housing, wherein the latch seal defines a dynamic seal to provide a seal between the latch arrangement and the connector housing during relative movement therebetween.

10. The releasable connector apparatus according to claim 5, wherein the sealing arrangement comprises a connector mandrel seal interposed between the connector mandrel and at least one of the connector housing and the latch arrangement when the connector mandrel is received within the socket of the connector housing.

11. The releasable connector apparatus according to claim 10, wherein the connector mandrel seal axially straddles an interface between the connector housing and the latch arrangement.

12. The releasable connector apparatus according to claim 10, wherein when the connector mandrel is received within the socket the connector mandrel seal isolates a latch seal from exposure to fluids/pressure within the socket.

13. The releasable connector apparatus according to claim 1, wherein the connector mandrel comprises an internal cavity which is in communication with the socket of the connector housing when the connector mandrel is received therein.

14. The releasable connector apparatus according to claim 13, wherein the internal cavity of the connector mandrel is arranged in communication with an environment surrounding the connector apparatus, such that the cavity facilitates communication between the socket and the surrounding environment.

15. The releasable connector apparatus according to claim 13, wherein the socket of the connector housing and the internal cavity of the connector mandrel are filled with a pressure medium.

16. The releasable connector apparatus according to claim 1, comprising a transmission connection providing a connection between the actuator and the latch assembly to permit the actuator to cause relative movement between the latch assembly and the connector housing.

17. The releasable connector apparatus according to claim 1, wherein the actuator comprises a force arrangement for applying a motive force between the actuator and the connector housing, wherein the force arrangement is configured to apply a bias force between the connector housing and the actuator in a direction to move and/or hold the actuator in its second position, corresponding to the disconnect position of the latch arrangement.

18. The releasable connector apparatus according to claim 17, wherein the actuator arrangement is moved and/or held relative to the connector housing against the bias force by action of gravity on the connector housing and any associated tool.

19. The releasable connector apparatus according to claim 17, wherein the force arrangement is configured to move the actuator towards its second position, corresponding to the disconnect position of the latch arrangement, in response to an initiation event.

20. The releasable connector apparatus according to claim 19, wherein the initiation event comprises at least partial removal of the weight of the connector housing and associated downhole tool from the connector mandrel.

21. The releasable connector apparatus according to claim 1, comprising a damping mechanism associated with the actuator to delay or restrict the rate of relative movement between the actuator and the connector mandrel in at least one direction.

22. The releasable connector apparatus according to claim 1, wherein the housing defines at least one access aperture to enable access to the actuator to permit an operator to move the actuator towards its first position and permit a connection to be made with the connector mandrel when said mandrel is received within the socket of the connector housing.

* * * * *